US006544658B2

(12) United States Patent
Robbins

(10) Patent No.: US 6,544,658 B2
(45) Date of Patent: Apr. 8, 2003

(54) NON-STICK POLYMER COATED ALUMINUM FOIL

(75) Inventor: Bruce Robbins, Richmond, VA (US)

(73) Assignee: Reynolds Metals Company, Richmond, VA (US)

( * ) Notice: Subject to any disclaimer, the term of this patent is extended or adjusted under 35 U.S.C. 154(b) by 0 days.

(21) Appl. No.: 09/853,636

(22) Filed: May 14, 2001

(65) Prior Publication Data

US 2002/0001727 A1 Jan. 3, 2002

Related U.S. Application Data

(63) Continuation-in-part of application No. 09/576,886, filed on May 24, 2000, now Pat. No. 6,423,417.

(51) Int. Cl.[7] ..... B31B 15/08

(52) U.S. Cl. ..... 428/458; 427/379; 427/388.1; 427/388.2; 427/374.3

(58) Field of Search ..... 427/374.3, 379, 427/388.1, 388.2; 428/458, 482

(56) References Cited

U.S. PATENT DOCUMENTS

| | | | | |
|---|---|---|---|---|
| 3,853,605 A | * | 12/1974 | Fahey | 427/172 |
| 3,861,939 A | | 1/1975 | Merrill et al. | 117/132 BJ |
| 4,032,678 A | * | 6/1977 | Perfetti et al. | 427/379 |
| 4,211,338 A | | 7/1980 | Bublitz | 220/359 |
| 4,279,717 A | | 7/1981 | Eckberg et al. | 204/159.13 |
| 4,421,904 A | | 12/1983 | Eckberg et al. | 528/27 |
| 4,977,198 A | | 12/1990 | Eckberg | 522/25 |
| 5,085,924 A | | 2/1992 | Eckberg | |
| 5,258,480 A | | 11/1993 | Eckberg et al. | 528/15 |
| 5,360,833 A | | 11/1994 | Eckberg et al. | 522/31 |
| 5,376,420 A | | 12/1994 | Yamamoto et al. | 428/40 |
| 5,397,813 A | | 3/1995 | Eckberg et al. | 522/31 |
| 5,446,312 A | | 8/1995 | Hsieh et al. | 257/559 |
| 5,482,780 A | | 1/1996 | Wilkie et al. | 428/515 |
| 5,543,457 A | | 8/1996 | Lewis et al. | 524/736 |
| 5,691,401 A | | 11/1997 | Morita et al. | 523/435 |
| 5,725,695 A | | 3/1998 | Ward et al. | 148/552 |
| 5,756,165 A | | 5/1998 | Ali et al. | 427/51.3 |
| 5,830,548 A | | 11/1998 | Andersen et al. | 428/36.4 |
| 5,942,557 A | | 8/1999 | Ooms et al. | 522/77 |

FOREIGN PATENT DOCUMENTS

| | | |
|---|---|---|
| EP | 0 471 589 A2 | 8/1991 |
| EP | 0 471 589 B1 | 8/1991 |
| EP | 0 471 589 A3 | 8/1991 |
| WO | WO 96/18497 | 6/1996 |

* cited by examiner

*Primary Examiner*—Robert Dawson
*Assistant Examiner*—Marc S Zimmer
(74) *Attorney, Agent, or Firm*—Nancy J. Flint; Tracey D. Beiriger

(57) ABSTRACT

A non-stick polymer coated aluminum foil and method of making it. The method of making a non-stick polymer coated aluminum foil comprising applying a curable polymer coating composition on at least a portion of one side of an aluminum foil and partially curing the coating composition to allow handling and further processing of the coated aluminum foil without blocking of the coating composition. The curing of the coating composition is completed by heating the coated aluminum foil in bulk. The polymer coating composition may include a cross-linkable polyester.

21 Claims, 1 Drawing Sheet

NON-STICK POLYMER COATED ALUMINUM FOIL

CROSS REFERENCE TO RELATED APPLICATIONS

The present application is a continuation-in-part of U.S. application Ser. No. 09/576,886, entitled "Non-Stick Polymer Coated Aluminum Foil, And Method of Making" filed on May 24, 2000, now U.S. Pat. No. 6,423,417, having the same inventor and assignee as this application, and which is incorporated herein by reference for all purposes.

FIELD OF THE INVENTION

The present invention relates to non-stick, curable polymer coating compositions, non-stick polymer coated articles, and a method of making the coated articles. More specifically, the invention relates to non-stick, curable coating compositions that are especially suitable for coating aluminum foil. The invention also relates to a coated aluminum foil and a method of making the coated aluminum foil.

BACKGROUND OF THE INVENTION

Non-stick, silicone-based coatings are used in the foodstuff sector for the finishing of baking tins and baking trays. They are typically sprayed on a substrate and cured either at room temperature or by heating the coated substrate to high temperatures. One problem associated with curing at high temperatures is that by-products are generated that impart an off-odor to the coated substrate. Moreover, curing at high temperatures is generally an expensive process with high operating costs and low throughput rates. Other problems exist.

Aluminum foil products and methods for making them are well known in the industry such as the ones described in U.S. Pat. Nos. 5,466,312 and 5,725,695, which are assigned to the assignee of the present invention, and which are incorporated herein by reference to the extent that they are not inconsistent with the disclosure and claims of the present invention. Aluminum foil products have many applications such as household wraps to contain food and other items and to make containers for food, drugs, and the like. For instance, U.S. Pat. No. 4,211,338, which is assigned to the assignee of the present invention, describes the use of a coated aluminum foil that is used to form a food container, wherein the coating is made with polyvinyl chloride resin.

BRIEF DESCRIPTION OF DRAWINGS

Reference is now made to the sole drawing of the invention wherein a schematic flow diagram is shown exemplifying one embodiment of the method of the invention.

SUMMARY OF THE INVENTION

Figure 1:
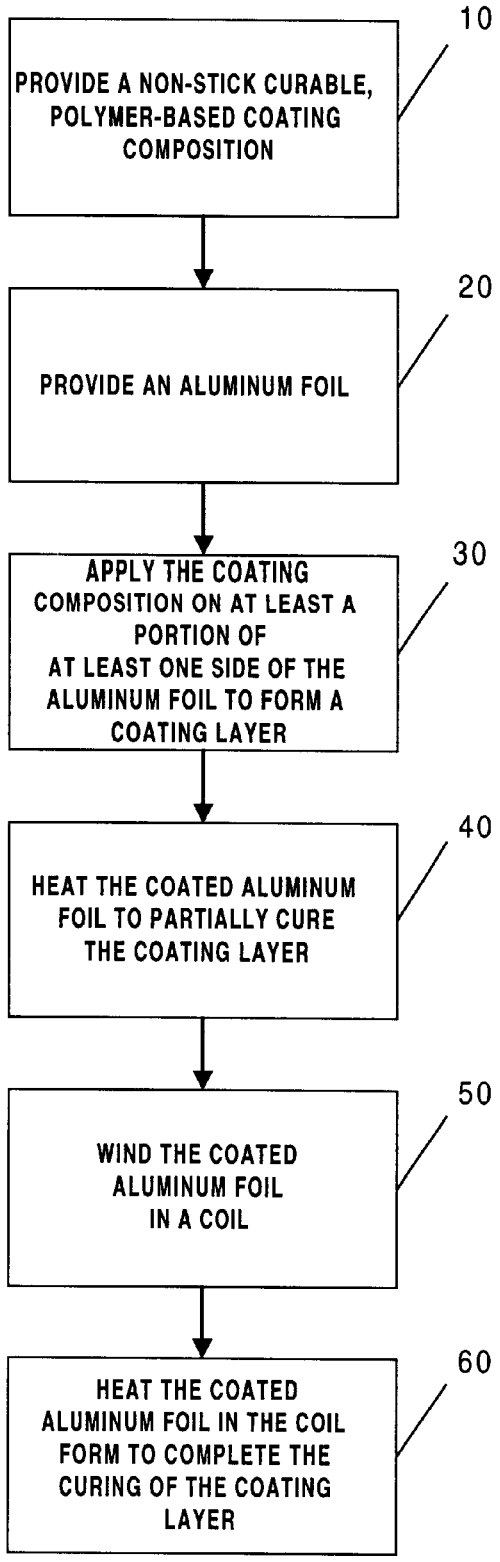

It is an object of the present invention to provide a non-stick, polymer-based coating composition that is suitable for coating metal articles such as aluminum foils.

It is another object of the present invention to provide a curable polymer coating composition that does not generate by-products during curing that impart an off-odor to the coated article.

It is yet another object of the present invention to provide a non-stick, polymer coated metal article such as aluminum foil that is acceptable for direct food contact.

It is yet another object of the present invention to provide a simple and economical method of making a non-stick, polymer coated aluminum foil or other non-stick, polymer coated metal articles.

These and other objects of the present invention will become apparent to those skilled in this art from the following description.

The present invention relates to a non-stick, curable polymer coating composition which includes a silicone resin, a silicone resin curing agent, a silicone release agent, a solvent and an effective amount of a hindered phenol antioxidant. The non-stick curable polymer coating may also be referred to herein as a "non-stick coating composition." The silicone resin may be selected from the group consisting of dimethyl polysiloxanes, polyester-modified methylphenyl polysiloxanes, hydroxyl functional silicone resins and mixtures thereof. These non-stick coating compositions are referred to also as silicone-based coating compositions.

The present invention also relates to a method for making non-stick, coated metal articles such as non-stick, coated aluminum foils. The method may include applying a non-stick curable polymer coating composition on at least a portion of one side of a metal article, and partially curing the coating in a first heating step to a level sufficient to allow further curing or completing the curing of the coating in bulk without blocking, sticking or other problems. The phrase "completing the curing" is used herein to mean sufficiently curing the coating to achieve the desired characteristics for the non-stick, coated metal article. It should be appreciated that the desired characteristics, such as the degree of non-stickiness, and bonding of the coating to the metal substrate may vary depending upon the desired application of the coated metal article. The partially cured coated metal article is then cooled and further cured in bulk in a second heating step. The metal article is preferably an aluminum article but other metals or alloys can be used. For example, the metal article also may be made of copper, silver, chromium or alloys thereof.

The present invention method may employ any non-stick, curable polymer coating composition, but it is particularly advantageous with coating compositions that require a generally high curing temperature and/or curing time. The method of the present invention is advantageous because it is simple and economical, it can be carried out at a high throughput rate, and it produces high quality product consistently without an off-odor.

The present invention also relates to non-stick, polymer coated articles such as non-stick, polymer coated aluminum foils made according to the present invention method. Preferably, the articles may be coated with a silicone-based or a polyester-based coating. The polyester-based coating composition may include a cross-linkable polyester resin, a cross-linking agent, and a solvent. Other non-stick, curable polymer coating compositions also may be used.

These and other advantages of the present invention will become apparent to those skilled in this art from the following description of preferred embodiments of the invention.

DETAILED DESCRIPTION OF PREFERRED EMBODIMENTS

In one illustrative embodiment of the present invention the coating composition includes a silicone resin, a silicone release agent, a silicone curing agent, a solvent and a hindered phenol. Silicone resins suitable for making the silicone-based coating composition of the present invention include dimethyl polysiloxanes, polyester-modified methylphenyl polysiloxanes, hydroxyl functional silicone resins and mixtures thereof.

Examples of most preferred silicone resins include BAYSILONE® resin M120XB supplied by GE SILICONES located at 260 Hudson River Road, Waterford, N.Y. 12188, and SILIKOFTAL® non-stick 50 which is manufactured by Goldschmidt Chemical corporation located at 914 E. Randolph Road, Hopewell, Va. 23860. The BAYSILONE® resin M120XB is a dimethyl polysiloxane and the SILIKOFTAL® non-stick 50 is a polyester-modified methylphenyl polysiloxane resin.

The silicone release agent enhances the release properties of the cured coating composition. Suitable release agents incorporated at an effective amount in the coating composition enhance the release properties of the cured coating composition such that foods stored or cooked in contact with the coating will not stick to the coating surface. Preferred silicone release agents include polydimethylsiloxane compounds such as DOW CORNING® 1-9770 compound which is a clear, high-viscosity, reactive silicone fluid, and SF96® 100 supplied by GE SILICONES, which is a clear, silicone fluid having a nominal viscosity of about 100 centistokes at 25° C. (77° F.). The release agent may be used in an amount ranging from about 0.1 to about 5.0 percent by weight, preferably from about 0.5 to about 4.5 percent, and most preferably from about 2.0 to about 3.5 percent by weight based on the weight of the silicone resin.

The silicone resin curing agent also referred to as a "curing catalyst" is used to initiate curing of the silicone resin. A preferred curing catalyst is zinc neodecanate. Other zinc salts such as for example zinc octoate also could be used. Preferably, the curing catalyst may be used in amounts ranging from about 0.05 to about 2 percent zinc metal, more preferably 0.1 percent and most preferably for about 0.1 to about 0.5 percent based on the weight of the silicone resin.

Any solvent that dissolves silicone resins can be used such as esters, ketones, glycol ethers, aliphatic hydrocarbons and aromatic hydrocarbons or mixtures thereof, preferably esters, ketones and glycol ethers. Most preferred solvents are ethyl acetate, and butyl acetate. The total amount of solvent in the coating composition mixture may vary depending upon the desired silicone resin solids content in the coating composition mixture. Preferably, the amount of silicone resin solids in the coating composition mixture may range from about 5 to about 50 percent by weight, preferably from about 10 to about 40 percent by weight and more preferably from about 20 to about 35 percent by weight.

Preferred hindered phenol antioxidants may include, but are not limited to 2,6-disubstituted phenols, bisphenols, polyphenols, substituted hydroquinones and substituted hindered anisoles. More preferred hindered phenols may include the 2,6-di-t-butyl-methylphenol ("butylated hydroxy toluene" or "BHT"), 2-t-butyl-4-methoxy phenol, 3-t-butyl-4-methoxy phenol, 4-(hydroxymethyl)2,6-di-t-butyl phenol, and styrenated phenols. BHT is the most preferred hindered phenol antioxidant.

The hindered phenol antioxidant is preferably used in an amount from about 0.1 to about 4.0 percent by weight and, more preferably from about 0.5 to about 3.0 percent by weight based on the weight of the silicone resin. Other antioxidants that are compliant with the regulations of the Food and Drug Administration for direct contact food applications and inhibit the conversion of alcohols to acids may also be used.

A curable silicone-based coating composition may be prepared by mixing all ingredients of the coating composition, and diluting the mixture with a solvent to the desired silicone resin solids content. Preferably, the silicone resin may be in a solution. The other ingredients of the composition are added to the silicone resin solution and stirred until dissolved. Additional solvent may be added to achieve the desired silicone resin solids content. The desired thickness of the coating and the method of application dictates the desired silicone resin solids content and thus the amount of additional solvent, if any, to be added to the composition. In all cases, however, the solvent is just a carrier for the coating. The solvent is removed during the first heating step.

The present invention further relates to non-stick, polymer coated articles such as non-stick, polymer coated aluminum foils and a method for making them. In one embodiment, a non-stick polymer coated aluminum foil is provided that includes a thin layer of a non-stick coating composition, applied on at least one portion of at least one side of the aluminum foil. The aluminum foil may be made according to U.S. Pat. Nos. 5,466,312 and 5,725,695, which are assigned to the assignee of the present invention and which are incorporated herein by reference to the extent that they disclose processes and aluminum alloy compositions for making aluminum foils. However, it should be appreciated that other aluminum alloy compositions and other processes also can be used in combination with the present invention.

Referring now to the sole figure, an exemplary processing sequence is illustrated for making a non-stick, curable, polymer coated aluminum foil, according to one embodiment of the present invention. The method includes providing a non-stick, curable, polymer-based coating composition, and an aluminum foil, according to blocks 10 and 20, respectively. Preferably, the aluminum foil may be in the form of a continuous sheet. Suitable coating compositions include the silicone-based and polyester-based compositions described herein as well as other curable polymer-based coating compositions well-known in this art. It will be appreciated that the method is particularly advantageous with non-stick, curable, polymer-based coating compositions that generally require high curing temperature and/or long curing time. The present invention includes steps for applying a non-stick coating composition onto an aluminum foil to form a coating layer (i.e. a "coating"), partial curing of the coating preferably in a continuous or semi-continuous process, collecting the aluminum foil in a bulk form and completing the curing by heating it in the bulk form.

The coating composition may be applied on at least one side, or on at least a portion of at least one side, of the aluminum foil to form a coating layer, according to block 30. Preferably, the coating may be applied uniformly to cover the whole area of at least one side of the foil using a conventional device such as a gravure cylinder. It should be appreciated, however, that only a portion of one side of the foil may be coated also. Other methods of applying the coating on the aluminum foil also can be used, such as dipping, brushing and spraying. Generally, the type of gravure cylinder used and the weight of the polymer or resin in the coating composition solution (solids, or resin content) determine the thickness of the layer of the dry coating. The coating composition may be applied onto the aluminum foil in an amount that may range from about 0.01 to about 1 pounds (0.00454 to 0.4536 kilograms) per ream (3,000 square feet), preferably from about 0.05 to about 0.2 pounds (0.02268 to 0.09072 kilograms) per ream, and more preferably from about 0.05 to about 0.1 pounds (0.02268 to 0.04536 kilograms) per ream, based on dried coating weight not including any solvent. However, thinner or thicker coating layers also can be made if desired. The thickness of the coating layer may vary depending on a number of factors including the composition of the coating and desired properties of the ultimate coated article.

Once the coating is applied onto the aluminum foil, the coated aluminum foil is subjected to a first heating step to partially cure the coating layer, according to block 40. This step also dries the coating by evaporation of any remaining solvent. The first heating step includes sufficiently curing the coating to allow further handling and processing of the partially cured coated aluminum foil to facilitate further or complete curing in bulk without blocking or sticking problems. Sufficient partial curing is accomplished by heating the aluminum foil to a sufficiently high temperature and for a sufficient time to allow handling and processing steps, such as winding the coated aluminum foil into a coil without blocking or sticking of the partially cured coating.

The temperature and time of the first heating step may vary depending upon such factors as the type of the coating composition, the solids content in the coating composition and the thickness of the coating. Throughout this application, the temperature of the first heating step refers to the peak metal temperature of the foil. Generally, the temperature and time of the first heating step are inversely proportional to one another. In other words a higher temperature will require less curing time (baking time) and conversely a lower temperature will require an increased curing time. In a coating line, the metal will reach a peak temperature that is usually below the recorded oven temperature. As the coating on the metal approaches this temperature, drying and curing may be occurring at varying rates. Preferably, the peak metal temperature of the first heating step, as measured at the surface of the coated aluminum foil, may range from about 300° F. (149° C.) to about 540° F. (282° C.). Generally, curing at lower temperatures may be more economical than curing at higher temperatures. Moreover, it may require less process time to reach a lower metal temperature than to reach a higher metal temperature. The time of the first heating step is such that the non-stick coating is sufficiently cured so as not to block or stick in subsequent processing steps.

The first heating step is preferably accomplished in a continuous or semi-continuous process. Any suitable heating means may be used. For example, the process may include supplying a continuous coated sheet at a sheet speed of about 200 feet per minute or higher to a first heating zone where sufficient heat is applied for a sufficient curing time to dry and partially cure the coating. The heating means may include conventional dryers, ovens, infrared heaters, induction heaters, heated rolls, or any other heating devices that can supply the required amount of heat uniformly onto the coated sheet. The speed for the continuous coating sheet is generally determined by the length and temperature of the heating means used, however, irrespective of the particular heating means used, the two-step curing method of the present invention provides a more efficient and economical operation than conventional one step curing processes. In one embodiment, a continuous sheet of a coated aluminum foil is passed at a speed of about 250 feet per minute through a 15 foot long oven. The oven is maintained at a sufficiently high temperature to ensure that the coated aluminum foil reaches an effective peak metal temperature for a sufficient amount of time before exiting the oven.

In one embodiment wherein only one side of an aluminum foil is coated with a silicone-based coating composition, it has been unexpectedly discovered that if the temperature of the metal surface of the side of the aluminum foil which is not covered by the silicone-based coating reaches a temperature of at least 480° F. (249° C.) during the first heating step, then a coating having a weight of from about 0.05 pounds per ream to about 0.1 pounds per ream is sufficiently cured to prevent blocking and sticking problems in the steps following the partial curing step.

In a preferred embodiment of the present invention, the application and partial curing of the coating is performed in a continuous or semi-continuous process at a desired throughput rate. For example, the aluminum foil may be provided in the form of a continuous sheet. The aluminum sheet may then be guided through an application zone where the coating may be applied using conventional methods. The coated aluminum foil may then be guided through a heating zone where sufficient heat is provided to sufficiently cure the coating to allow further handling and curing of the coated foil in bulk form.

The method also includes collecting the coated aluminum foil having the partially cured coating in some bulk form, for example, winding a continuous sheet of partially cured coated aluminum foil into a coil, according to block 50. Alternatively, collecting the aluminum foil in bulk form may include, for example, cutting a continuous sheet of an aluminum foil into separate sheets, then stacking the sheets into bales. On a production line, coils may be collected together prior to subjecting them to a second curing step. While in queue, the temperature of the coils may gradually approach room temperature. Cooling may also be accelerated by any one or a combination of well-known methods, such as application of directed air, liquid, or other cooling medium. Generally, however, it is not necessary to cool down a partially-cured coil to room temperature prior to the second curing step.

The coated aluminum foil in the coil or some other bulk form is then subjected to a second heating step to complete the curing of the coating layer, according to block 60. This step is also referred to as a reheating step or final curing step. The second heating step includes heating the coated aluminum foil to a temperature and for a time sufficient to complete the curing of the coating composition in bulk to achieve the desired coating characteristics. The coating characteristics may vary depending upon the desired application for the coated aluminum foil product. For example, desired coating characteristics may include the degree of non-stickiness of the coating layer and the degree of bonding of the coating layer to the aluminum foil substrate. Non-stickiness may be determined by cooking, grilling and freezing tests as described in the Examples. Bonding to the substrate may be determined by a tape adhesion test also described in the Examples.

The temperature and time of the second heating (or second curing) step also may depend upon the composition and the thickness of the coating. For example, in one preferred embodiment, which employs a silicone-based coating composition, a coated aluminum foil with a coating having a weight of about 0.05 to about 0.3 pounds per ream is reheated to a temperature of about 425° F. (218° C.) for a time of about three hours. The temperature of the second heating step refers to the temperature of the metal surface of the least heated portion of the aluminum foil in the bulk form. Lower temperatures with longer cure times, or higher temperatures with shorter cure times also can be used. Generally, it is preferred to employ lower temperatures and longer cure times in order to minimize operating costs of the second heating step. For example, preferably the coated aluminum foil may be heated to a temperature of from about 350° F. (177° C.) to about 500° F. (260° C.), and more preferably to a temperature of from about 400° F. (204° C.)

to about 450° F. (232° C.). The heating time also referred to hereinafter as the heating soak time (or soak time) may range from a few seconds to a few hours, preferably from about a few minutes to about 5 hours, and more preferably from about 1 hour to about 4 hours. The second curing step may include heating the aluminum foil, while in bulk form, using any suitable heating means such as a dryer, a conventional oven, infrared or induction heaters, or other means as will be appreciated in the art. The temperature of the heating means may vary depending on many factors, such as the configuration of the heating means, the form and size of the aluminum foil, the thickness and composition of the coating, the curing time, and other factors.

The heating time and temperature for the second heating step refer to the least exposed portion of the coil. Where the aluminum foil is in coil form, coated material in the center of the coil may take longer to reach the desired curing temperature than material on the outer layer of the coil. Thus, a larger coil may generally require a higher temperature and/or a longer soak time than a smaller coil to ensure sufficient heating of the coating composition throughout the entire coil. For example, a coil 30 inches in diameter and 12 inches wide, heated inside an oven that maintains an air temperature of about 400° F. (204° C.), may require a total soak time of 18–24 hours, or longer. The soak time may also vary based on the number of coils that are heated inside the oven at the same time.

During curing, some residual solvent or by-products of the curing reaction may be released, depending on the coating composition used. Without intending to limit the invention in any way, it is theorized that the addition of a hindered phenol antioxidant may prevent oxidation of these by-products, which otherwise may result in an off-odor imparted to the coating.

In yet another embodiment of the present invention method, a polyester-based curable coating composition may be used that includes a cross-linkable (or curable) polyester resin, a cross-linking agent, and a solvent. A hindered phenol antioxidant may be added to prevent an off-odor, if needed. Other additives may also be included, such as release agents. Suitable polyester resins may include polycondensation products of dicarboxylic or, polycarboxylic acids with dihydroxy or polyhydroxy alcohols. Preferably, the polyester resins may exhibit a number average molecular weight from about 1,500 to 10,000.

Suitable acids may include terephthalic acid, isophthalic acid, adipic acid, succinic acid, glutaric acid, fumaric acid, maleic acid, cyclohexane dicarboxylic acid, azeleic acid, sebasic acid, dimer acid, substituted maleic and fumaric acids such as citraconic, chloromaleic, mesaconic, and substituted succinic acids such as aconitic and iraconic. Acid anhydrides may also be used.

Suitable alcohols may include, for example, ethylene glycol, propylene glycol, diethylene glycol, neopentyl glycol, dipropylene glycol, butanediol, hexamethylemediol, 1,2-cyclohexanedimethanol, 1,3-cyclohexanedimethanol, 1,4-cyclohexanedimethanol, trimethylol propane, pentaerythritol, neopentyl glycol hydroxypivalate diethylene glycol, triethylene glycol, tetraethylene glycol, dipropylene glycol, polypropylene glycol, hexylene glycol, 2-methyl-2-ethyl-1,3-propanediol, 2-ethyl-1,3-hexanediol, 1,5-pentanediol, 1,2-cyclohexanediol, 1,3-butanediol, 2,3-butanediol, 1,4-cyclohexanediol, glycerol, trimethylolpropane, trimethylolethane, 1,2,4-butanetriol, 1,2,6-hexanetriol, dipentaerythritol, tripentaerythritol, mannitol, sorbitol, methyglycoside, and mixtures thereof.

The polyester resin typically may be cross-linked through its double bonds with a compatible cross-linking agent. Examples of suitable cross-linking agents include styrene, diallyl phthalate, and diallyl ether, butylated or methylated urea-formaldehyde resins, butylated melamine-formaldehyde resins, hexamethoxymethylmelamine or mixtures of various hydroxymethyl-melamine-methyl ethers such as the pentamethyoxymethylmelamime and the tetramethoxymethyl melamines, and high-amino/polymeric melamines. The hydroxymethylmelamine and hydroxymethyl ureas may also be etherified with alcohols other than methyl or butyl such as ethyl, propyl, isobutyl and isopropyl.

Preferably the cross-linking agent may be incorporated into the coating composition in an amount of from about 2 up to about 25 percent by weight, more preferably from about 3 to about 20 percent by weight, based on the combined weight of all components present in the coating composition. Generally, the lower the molecular weight of the polyester polymer, the larger the number of terminal hydroxy groups present and the larger the quantity of crosslinking agent required to properly cure the resin. Conversely, the higher the molecular weight of the polyester polymer, the fewer the number of terminal hydroxy groups and the lesser the quantity of crosslinking agent required to properly cure the resin.

One or more solvents for making a polyester resin can be used. It is often desirable to use mixtures of solvents in order to effect the best solubilization, such as a combination of aromatic solvents with compatible oxygenated solvents. Suitable aromatic solvents include toluene, xylene, ethylbenzene, tetralin, naphthalene, and solvents which are narrow cut aromatic solvents comprising $C_8$ to $C_{13}$ aromatics. Suitable oxygenated solvents include propylene glycol monomethyl ether acetate, propylene glycol propyl ether acetate, ethoxypropionate, dipropylene glycol monomethyl ether acetate, propylene glycol monomethyl ether, propylene glycol monopropyl ether, dipropylene glycol monomethyl ether, diethylene glycol monobutyl ether acetate, ethylene glycol monoethyl ether, dipropylene glycol monomethyl ether, diethylene glycol monobutyl ether acetate, ethylene glycol monobutyl ether, diethylene glycol monoethyl ether, diethylene glycol monoethyl ether acetate, ethyl acetate, n-propyl acetate, isopropyl acetate, butyl acetate, isobutyl acetate, amyl acetate, isoamyl acetate, mixtures of hexyl acetates, acetone, methyl ethyl ketone, methylisobutyl ketone, methyl amylketone, methyl isoamyl ketone, methylheptyl ketone, isophorone, isopropanol, n-butanol, sec.-butanol, isobutanol, amyl alcohol, isoamyl alcohol, hexanols, and heptanols. Solvents are generally selected to obtain coating compositions having viscosities and evaporation rates suitable for the application and curing of the coatings. Preferably, solvent concentrations in the coating compositions may range from about 60 to about 95 percent by weight and more preferably from about 80 to about 90 percent by weight for gravure applications.

Acid catalysts may also be used to cure polyester-based coating compositions containing hexamethoxymethyl melamine or other amino crosslinking agents. A variety of suitable acid catalysts are known, such as p-toluene sulfonic acid, methane sulfonic acid, nonylbenzene sulfonic acid, phosphoric acid, mono and dialkyl acid phosphate, butyl phoshpate, butyl maleate, and the like or a compatible mixture of them. These acid catalysts may be used in their neat, unblocked form, or they may be combined with suitable blocking agents such as amines.

In some cases, carboxylic acids can be used as catalysts for the crosslinking reaction. At high curing temperatures the activity of residual carboxylic groups on the backbone polymer may sometimes provide sufficient catalysis to promote the crosslinking reaction.

The amount of catalyst employed typically varies inversely with the severity of the curing schedule. In particular, smaller concentrations of catalyst are usually required for higher curing temperatures or longer curing times.

A preferred polyester-based coating composition is a composition supplied under the trade name LTC14562SA by Selective Coatings and Inks, Inc., which is located in Ocean, N.J. A preferred solvent used in conjunction with this polyester is a composition comprising n-propyl-acetate, polypropylene glycol methyl ether acetate, and isopropyl alcohol. The total amount of solvent used may vary depending on the properties desired in the final product. Other solvents and other polyester based coatings also may be utilized. It has been found that the LTC14652SA coating composition does not require the addition of a hindered phenol antioxidant.

In an embodiment wherein a polyester-based coating composition is employed, a preferred temperature range of the metal surface of the side of the aluminum foil which is not covered by the coating preferably may range from about 300° F. (149° C.) to about 350° F. (177° C.) for the first curing step and from about 350° F. (176.6° C.) to about 425° F. (218° C.) for the second curing step. These curing temperatures have been found to be sufficient for a polyester-based coating having a weight of from about 0.05 pounds per ream to about 0.20 pounds per ream.

For different coating compositions or coating weights the preferred temperature and time of the first and second curing steps may vary, however they can be readily determined by simple experimentation. If for any reason insufficient heating is achieved in the first heating step, the coating will have a tendency to block or stick in the steps following the first curing step.

According to an embodiment of the present invention the aluminum foil having a partially cured coating layer from the first curing step is slit in separate sheets that are arranged in stacks. The stacks are then placed inside an oven to complete the curing of the coating layer. Alternatively, the foil may be slit after complete curing, spooled and further processed as necessary to provide commercial products. If only one side of the aluminum foil is coated it is preferred, either during the curing process or in subsequent processing, to use a technique, such as embossing text in the foil, to indicate which side is the coated or non-stick side.

The method of the present invention allows application of a curable coating layer to an aluminum foil or other metal articles at an optimum production rate. Moreover, the method of the present invention does not impart an undesirable off-odor to the aluminum foil as a result of curing the coating.

Other variations and modifications within the scope of the invention will become apparent when considered together with the following examples, which are set forth as being merely illustrative of the invention and which are not intended, in any manner, to be limiting. Unless otherwise indicated, all parts and percentages are by weight.

EXAMPLES

Example 1

A non-stick, polymer coating was made having the following composition.

| | Parts |
|---|---|
| Silicone Resin (50% in solution) | 200 |
| Silicone release agent | 2.8 |
| Zinc neodecanate | 1.2 |
| BHT (butylated hydroxy toluene) | 0.1 |

The silicone resins used were 50% solvent and 50% solids, thus the amounts listed in the above table are based on 100 parts of the silicone resin solids. The silicone resin was SILIKOFTAL®, non-stick 50 and the silicone release agent was SF96® 100.

Example 2

The non-stick polymer coating as in Example 1 was made in the same way, except that the silicone resin was BAYSILONE® resin M 120XB.

Example 3

The non-stick polymer coating as in Example 1 was made in the same way, except that the silicone release agent was Dow Corning 1-9770.

Example 4

The non-stick polymer coating as in Example 1 was made in the same way, except that the silicone release agent was used in an amount of 3.2 parts based on 100 parts of silicone resin solids, i.e., 3.2 percent by weight based on the silicone resin weight.

Example 5

The non-stick, polymer coating as in Example 1 was made in the same way, except that the silicone release agent is used in an amount of 5 parts based on 100 parts of silicone resin solids.

Example 6

The non-stick, polymer coating as in Example 1 was made in the same way, except that the BHT was used in an amount of 0.5 parts based on 100 parts of silicone resin solids.

Example 7

The non-stick, polymer coating as in Example 1 was made in the same way, except that the BHT was used in an amount of 1.0 parts based on 100 parts of silicone resin solids.

Example 8

The non-stick, polymer coating as in Example 1 was made in the same way, except that the BHT was used in an amount of 2.0 parts based on 100 parts of silicone resin solids.

Example 9

Non-stick, polymer coated aluminum foils were prepared using the coating compositions as in Examples 1–4. Due to the solvent that comes with the silicone resins, the silicone resin solids content of the coating compositions was initially just above 50 percent. The silicone resin solids content of the coating compositions was then diluted to a range of from about 20 to about 35 percent using ethyl acetate as a solvent.

The coating compositions of Examples 1–4 were applied uniformly on one side of the aluminum foil using a gravure cylinder to form a coating layer in an amount of about 0.75 pounds (0.3402 kilograms) per ream.

Once the coating compositions were applied, the foil with the coating in web form was passed through an oven where the coating was dried and partially cured. During this step the oven temperature was set sufficiently high to allow the metal surface temperature of the coated foil to reach at least 480° F. (249° C.) at the desired throughput rate.

The aluminum foil was then wound up in a coil and gradually cooled using air. Following the cooling step, the aluminum foil was subjected to a final heating step to complete the curing of the coating at an oven temperature sufficient to provide a metal temperature of the surface of the aluminum foil that was not covered with the coating of about 425° F. (218° C.). The presence of BHT substantially prevented the generation of an off-odor in this curing step by inhibiting the formation of oxidative by-products.

Example 10

The method as in Example 9 is repeated to make a non-stick, polymer coated aluminum foil, except that the metal surface temperature of the aluminum foil in the first heating step reaches 500° F. (260° C.).

Example 11

The method as in Example 10 is repeated to make a non-stick, polymer coated aluminum foil, except that the temperature of the aluminum foil in the second heating step reaches 400° F. (204° C.).

The coated aluminum foils of Examples 9–11 had a satisfactory non-stick coated surface, and no off-odor. Moreover, no blocking or sticking problems were experienced between the first and second curing steps or during the second curing step.

Example 12

The degree of non-stickiness of the non-stick, polymer coated aluminum foils of Example 9–11 are determined by a series of cooking, grilling and freezing tests.

Cooking Tests

Cookie dough such as NESTLE TOLL HOUSE reduced fat chocolate chip cookie dough is placed by a rounded teaspoon on cookie sheets made with the non-stick, polymer coated aluminum foils prepared according to Examples 9–11 and baked in an oven in accordance with the directions on the package. After cooling for 3 minutes, the cookies are removable with a spatula and leave no residue on the foil.

Chicken pieces, with and without skin are placed on a baking pan lined with a non-stick, polymer coated aluminum foil prepared according to Example 9 in an oven at 400° F. (204° C.) for 50 minutes. After cooking, the chicken does not stick to the foil.

Grilling Tests

A non-stick, polymer coated aluminum foil prepared according to Examples 9–11 is placed on a grill preheated to 400–450° F. (204–232° C.). Cod filets, approximately ½–¾ pounds each are cooked for 10–15 minutes, turning twice. The fish does not stick to the foil.

Foil is placed on a grill preheated to 400–450° F. (204–232° C.). Chicken pieces, with and without skin are placed on the foil and grilled for 15 to 35 minutes. After cooking, the chicken pieces do not stick to the foil.

Freezing Tests

Hamburger patties are separated by sheets of non stick, polymer coated aluminum foil prepared according to Examples 9–11. The hamburger patties are overwrapped with foil and placed in the freezer for 5 days. After removal, the patties are easily separated and do not stick to the foil.

Example 13

Bonding to the substrate is determined by a tape adhesion test. A fresh piece of 1 inch wide Scotch 3M cellophane tape #610 is placed on a sample of a non-stick, polymer coated aluminum foil, prepared according to Examples 9–11, in the cross machine direction, leaving a free length for grasping. The tape is smoothed using finger pressure. The tape is pulled back at an angle of approximately 45°, quickly, but not jerked and at a rate not so great as to cause rupture of the substrate or tearing of the tape. Acceptable bonding is achieved if no coating is removed.

Example 14

Samples of non-stick, polymer coated aluminum foils prepared according to Examples 9–11 are exposed in an oven for 24 hours at 600° F. (315.5° C.). No substantial peeling, cracking or loss of coating is observed.

Example 15

A non-stick, polymer coated aluminum foil was prepared using a polyester-based coating composition. The polyester composition was LTC14562SA available from Selective Coatings and Inks, Inc. Due to the solvent that comes with the resins, the solids content of the coating composition was initially about 53±1 percent. The solvent used was about 26.8 percent by weight n-propyl acetate, 17.6 percent by weight propylene glycol methyl ether acetate and about 1.6 percent by weight isopropyl alcohol. The resin solids content of the coating composition was further diluted to about 24 percent by weight using ethyl acetate as a solvent.

The coating composition was then applied uniformly on one side of an aluminum foil using a 900 line per inch ceramic gravure cylinder to form a coating layer in an amount of about 0.17 pounds (0.077 kilograms) per ream.

Once the coating composition was applied, the foil with the coating in web form was passed through an oven where the coating was dried and partially cured. During this step the oven temperature was set sufficiently high to allow the metal surface of the coated foil that was covered with the coating to reach 350° F. (176° C.) at the desired throughput rate.

The aluminum foil was then wound up in a coil and gradually cooled using air. Following the cooling step, the aluminum foil was heated in a second heating step to complete the curing of the coating at an oven temperature sufficient to allow the metal surface of the coated aluminum foil that was not covered with the coating to reach a temperature of about 390° F. (199° C.). When the least heated interior portion of the foil reached this temperature as measured by a thermocouple inserted in the coil, the aluminum foil was kept at this temperature for about 2 hours. After the second heating step was completed, no sticking or blocking of the aluminum foil was observed.

Example 16

The method as in Example 15 was repeated to make a non-stick, polymer coated aluminum foil except that the metal surface temperature of the aluminum foil in the first heating step reached about 300° F. (149° C.). Lowering the temperature of the first heating step further increased the overall speed of the process from about 150 feet per minute to about 250 feet per minute.

The coated aluminum foils of Examples 15–16 had a satisfactory non-stick coated surface, and no off-odor without the addition of BHT. Moreover, no blocking or sticking problems were experienced between the first and second curing steps or during the second curing step.

Example 17

The degree of non-stickiness of the non-stick, polymer coated aluminum foils of Examples 15 and 16 was determined by the cooking test described below.

Cookie dough such as NESTLE TOLL HOUSE reduced fat chocolate chip cookie dough was placed by a rounded teaspoon on cookie sheets made with the non-stick, polymer coated aluminum foils prepared according to Examples 15–16 and baked in an oven in accordance with the directions on the package. After cooling for 3 minutes, the cookies were removed with a spatula and left no residue on the foil.

Chicken pieces, with and without skin were brushed with barbecue sauce and were placed on a baking pan lined with a non-stick, polymer coated aluminum foil prepared according to Examples 15–16 in an oven at 375° F. (191° C.) for 55 minutes. After cooking, the chicken did not stick to the foil.

While no grilling or freezing tests were conducted with the polymer coated aluminum foils of examples 15 and 16, it is believed they would yield the results discussed in Example 12 above.

Example 18

Bonding to the substrate was determined by a tape adhesion test. A fresh piece of 1 inch wide Scotch 3M cellophane tape #610 was placed on a sample of a non-stick, polymer coated aluminum foil, prepared according to Examples 15–16, in the cross machine direction, leaving a free length for grasping. The tape was smoothed using finger pressure. The tape was pulled back at an angle of approximately 45°, quickly, but not jerked and at a rate not so great as to cause rupture of the substrate or tearing of the tape. Acceptable bonding was achieved if no coating was removed.

Example 19

Samples of non-stick, polymer coated aluminum foils prepared according to Examples 15 and 16 were exposed in an oven for 24 hours at 600° F. (315.5° C.). No substantial peeling, cracking or loss of coating was observed.

Example 20

A non-stick, polymer coated aluminum foil was made as in Example 15, except that the metal surface of the aluminum foil in the first heating step only reached a temperature of 250° F. (121° C.). The throughput rate of the first heating step was increased to 350 feet per minute (from 150 feet per minute in Example 15). The time and temperature of the second heating step were the same as in Example 15. In this trial, the material was observed to stick and block after the second heating step.

The foregoing examples have been presented for the purpose of illustration and description only and are not to be construed as limiting the scope of the invention in any way. The scope of the invention is to be determined from the claims appended thereto.

I claim:

1. A method of making a coated metal article comprising:

applying a curable polyester-based coating composition on at least a portion of one side of a metal article to form a coated metal article including a coating; and partially curing the coating in a first heating step by heating the coated metal article at a sufficiently high temperature to allow completion of the curing of the coated metal article in bulk without blocking.

2. The method of claim 1, wherein the metal article is an aluminum foil.

3. The method of claim 2, wherein said first heating step further comprises passing the coated aluminum foil through an oven in a continuous process at a throughput rate and at an oven temperature sufficient to allow the temperature of the metal surface of the aluminum foil to reach a temperature of at least about 300° F. as the coated aluminum foil exits the oven.

4. The method of claim 2, further comprising the steps of winding the partially cured coated aluminum foil in a coil;

cooling the aluminum foil in coil form; and a second heating step comprising heating the aluminum foil in coil form to a temperature and for a time sufficient to complete the curing of the coating composition.

5. The method of claim 2, wherein said coating composition is applied on said aluminum foil in an amount of from about 0.025 lbs. to about 0.2 lbs. per 3,000 square feet.

6. The method of claim 4, wherein said cooling of the aluminum foil in coil form is done gradually.

7. The method of claim 2, wherein said coating composition comprises a cross-linkable polyester resin, a curing agent, and a solvent.

8. The method of claim 2, wherein said first heating step comprises heating the aluminum foil in web form to a temperature of from about 300° F. to about 350° F.

9. The method of claim 4, wherein said second heating step comprises heating the aluminum foil in coil form to a temperature of from about 350° F. to about 425° F.

10. The method of claim 7, wherein said coating composition further comprises a release agent.

11. A method of making a non-stick, coated aluminum foil comprising:

applying a curable polyester-based coating composition on at least a portion of one side of an aluminum foil;

partially curing the coating composition sufficiently to allow winding the aluminum foil in coil form without blocking of the coating composition; and completing the curing of the coating composition by heating the aluminum foil in coil form.

12. The method of claim 11, wherein completing the curing comprises heating the aluminum foil in coil form in an oven without blocking of the aluminum coil comprising the coating composition.

13. The method of claim 11, wherein completing the curing comprises heating the aluminum foil in coil form to a temperature of from about 350° F. to about 425° F., for a time of from about 1 hour to about 5 hours.

14. The method of claim 11, wherein completing the curing comprises heating the aluminum foil in coil form to a temperature of at least about 350° F. for a time of at least about 5 minutes.

15. The method of claim 10, wherein said coating composition comprises a cross-linkable polyester resin, a curing agent, and a solvent.

16. A non-stick, polymer coated aluminum foil formed according to the method of claim 4.

17. A non-stick, polymer coated aluminum foil formed according to the method of claim 11.

18. A non-stick polymer coated metal article comprising:

a metal article; and a non-stick, polyester based coating bonded on at least a portion of one side of the metal article, wherein the coating is formed by:

applying a non-stick, polyester-based coating on at least a portion of one side of the metal article;

partially curing the coating in a first heating step by heating the coated metal article at a sufficiently high temperature to allow completion of the curing of the coated metal article in bulk without blocking;

gradually cooling and collecting the partially cured article in a bulk form; and heating the metal article in bulk form to a temperature and for a time sufficient to complete the cure of the coating composition.

19. The coated metal article of claim 18, wherein said metal article is a foil.

20. The coated metal article of claim 18, wherein said metal article is made of a metal comprising aluminum, copper, silver, chromium or alloys thereof.

21. The article of claim 18, wherein collecting the partially cured coated metal article in a bulk form comprises winding the partially cured coated metal article.

* * * * *

UNITED STATES PATENT AND TRADEMARK OFFICE

CERTIFICATE OF CORRECTION

PATENT NO. : 6,544,658 B2
DATED : April 8, 2003
INVENTOR(S) : Bruce Robbins

It is certified that error appears in the above-identified patent and that said Letters Patent is hereby corrected as shown below:

Column 14,
Line 65, "10" should read -- 11 --.

Signed and Sealed this

Ninth Day of September, 2003

JAMES E. ROGAN
*Director of the United States Patent and Trademark Office*